US008665301B2

(12) United States Patent
Starkey et al.

(10) Patent No.: US 8,665,301 B2
(45) Date of Patent: Mar. 4, 2014

(54) TAPE DRIVE AND METHOD OF OPERATION OF A TAPE DRIVE

(75) Inventors: Simon Starkey, Leicester (GB); Phillip Lakin, Nottingham (GB)

(73) Assignee: Markem-Imaje Limited, Nottingham, Nottinghamshire (GB)

( * ) Notice: Subject to any disclaimer, the term of this patent is extended or adjusted under 35 U.S.C. 154(b) by 0 days.

(21) Appl. No.: 13/810,529

(22) PCT Filed: Jul. 21, 2011

(86) PCT No.: PCT/GB2011/051384

§ 371 (c)(1),
(2), (4) Date: Jan. 16, 2013

(87) PCT Pub. No.: WO2012/010901

PCT Pub. Date: Jan. 26, 2012

(65) Prior Publication Data

US 2013/0113870 A1 May 9, 2013

(30) Foreign Application Priority Data

Jul. 22, 2010 (GB) ..... 1012314.9

(51) Int. Cl.

| | |
|---|---|
| ***B41J 33/16*** | (2006.01) |
| ***B41J 33/34*** | (2006.01) |
| ***B41J 35/08*** | (2006.01) |

(52) U.S. Cl.

USPC ..... 347/217

(58) Field of Classification Search

USPC ..... 347/215, 217; 400/223, 225, 234, 236

See application file for complete search history.

(56) References Cited

U.S. PATENT DOCUMENTS

| | | | |
|---|---|---|---|
| 5,275,351 | A | 1/1994 | Wu et al. |
| 5,573,202 | A | 11/1996 | Morgavi |

(Continued)

FOREIGN PATENT DOCUMENTS

| | | | |
|---|---|---|---|
| GB | 2400582 | B | 3/2005 |
| GB | 2448305 | B | 10/2008 |

(Continued)

OTHER PUBLICATIONS

International Search Report for Application No. PCT/GB2011/051384 mailed Nov. 29, 2011, 4 pages.

(Continued)

*Primary Examiner* — Huan Tran
(74) *Attorney, Agent, or Firm* — Fish & Richardson P.C.

(57) ABSTRACT

A method of operation of the tape drive, including obtaining the circumferences a supply spool, and a take-up spool, each spool being mounted upon a respective rotatable spool support which is mounted in a housing, the method including rotating the take-up spool support and the supply spool support simultaneously, so as to feed tape from the supply spool into a tape path extending between the spools, and to wind tape on to the take-up spool from the tape path, determining a length of tape fed into the tape path during a measurement period using a sensor assembly, monitoring the angle through which each of the spool supports has rotated during the measurement period, regulating the length of the tape in the tape path, such that the length of the tape in the tape path at the start of the measurement period and the length of the tape in the tape path at the end of the measurement period are substantially the same, and using knowledge of the length of tape fed into the tape path during the measurement period and the angle through which each of the spool supports rotated during the measurement period to obtain the circumferences of the supply spool and the take-up spool.

26 Claims, 2 Drawing Sheets

(56) References Cited

U.S. PATENT DOCUMENTS

Figure 1:
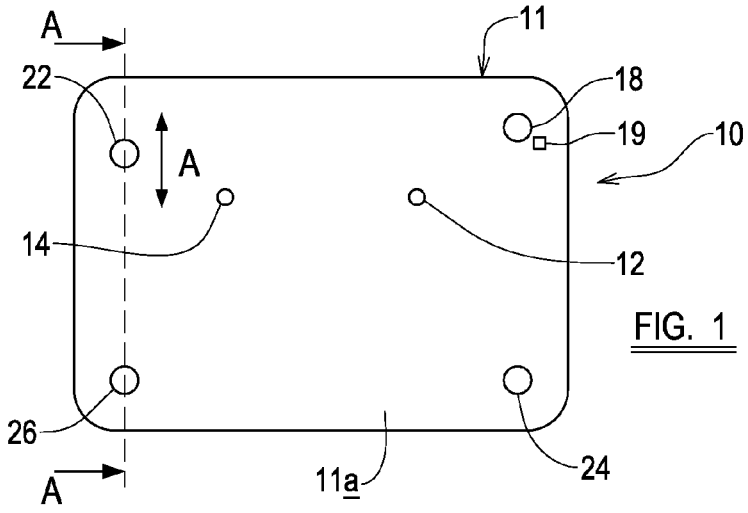

2006/0266869 A1 11/2006 Quittkat
2008/0240830 A1* 10/2008 McNestry ..... 400/234

FOREIGN PATENT DOCUMENTS

GB 2449676 B 12/2008
WO WO03029013 A1 4/2003
WO WO2008107642 A1 9/2008

OTHER PUBLICATIONS

International Preliminary Report on Patentability and Written Opinion for Application No. PCT/GB/2011/051384, issued Jan. 22, 2013, 6 pages.
Search Report for Application No. GB1012314.9 dated Nov. 10, 2010, 1 page.

* cited by examiner

A-A

TAPE DRIVE AND METHOD OF OPERATION OF A TAPE DRIVE

CROSS REFERENCE TO RELATED APPLICATIONS

This application is a §371 National Stage Application of International Application No. PCT/GB2011/051384, filed Jul. 21, 2011, which claims priority to GB Application No. 1012314.9, filed Jul. 22, 2010, each of which is incorporated herein by reference in its entirety.

The present invention relates to a tape drive, particularly, but not exclusively, to a tape drive for use in a printing apparatus, and a method of operating such a tape drive, including obtaining the circumferences of a pair of spools of tape.

It has long been known to provide tape drives which include two spool supports, one of which supports a supply spool on which unused tape is initially wound, and the other of which supports a take-up spool, onto which the tape is wound after it has been used. Tape extends between the spools in the tape path. Each of the spool supports, and hence each of the spools, of tape is drivable by a respective motor. Such tape drives may be incorporated into a printing apparatus, wherein the tape is an inked ribbon which is moved past a printhead to enable a printing operation to be carried out, to transfer ink from the tape to a substrate (or a part of a substrate) which is positioned adjacent the printhead.

In order to avoid wasting ink, whilst maintaining acceptable print quality, it is advantageous to be able accurately to control the movement of the tape, so as to position the next portion of tape to be used directly adjacent a portion of the tape from which the ink has previously been removed.

Since such tapes are very thin, it is important to ensure that the tension in the tape extending between the two spools is maintained between predetermined limits. Too much tension in the tape is likely to lead to the tape being deformed or broken, whilst too little tension will inhibit the correct operation of the device. In the case of a printer, a slack tape is likely to affect print quality. As a tape is wound onto the take-up spool, the diameter (and, of course, the circumference) of the take-up spool increases, and the diameter (and circumference) of the supply spool decreases. This affects the moments of inertia of the two spools, and hence the angular momentum of each of the spools. If both spools were driven at a constant angular velocity, the amount of tape fed into the tape path per degree of rotation of the supply spool would decrease as the circumference of the supply spool decreased, whilst the amount of tape wound on to the take up spool per degree of rotation would increase. This would eventually lead to the tension of the tape increasing beyond an acceptable limit. Therefore the angular velocity (or step rate) of at least one of the spools is generally variable.

It is known to control the rotational speed and the direction of rotation of the motors which drive the spools, by means of a controller, in order to maintain the tension in the tape between the supply spool and the take-up spool between predetermined limits. In order to control the motors appropriately, it is necessary to take into account the diameters/circumferences of the spools.

It will be appreciated that the spools are unlikely to be perfectly circular, and will exhibit some degree of eccentricity. In most known methods, it is assumed that the spools are circular, and thus that circumference or diameter which has been obtained is accurate, or it is necessary to carry out a series of measurements, and to obtain an average spool circumference or diameter for each spool.

One method of calculating the circumference of one of the spools is to drive the take-up spool to cause the take-up spool to rotate through a known number of degrees, whilst the motor of the supply spool is disabled. Tape is thus pulled on to the take-up spool, and dragged from the supply spool. The tape passes a roller which is positioned in the path of the tape between the supply spool and the take-up spool. The transfer of tape from the supply spool to the take-up spool causes the roller to rotate. Monitoring the number of rotations of the roller provides an indication of the length of tape which has been pulled on to the take-up spool. From knowledge of the angle through which the take-up spool has moved, and the length of tape which has been pulled on to the take-up spool, it is possible to calculate the circumference and the average diameter of the take-up spool. The supply and take-up spools can then be driven in the opposite sense, i.e. the take-up spool is disabled and the supply spool is driven, so that tape is pulled on to the supply spool (which has thus become the take-up spool) and dragged from the take-up spool (which becomes the supply spool). The amount of tape pulled onto the new take-up spool can be determined by monitoring the number of rotations of the roller. Alternatively, if the ratio of spools is known, the circumference of the spool which has not been calculated can be inferred from the circumference of the first spool. It is necessary to carry out this two-step measurement of the circumferences in a calibration step, since it is necessary to disable each of the motors separately and to transfer the tape in both directions.

The disadvantages of such methods are that it is difficult to maintain adequate tension in the tape whilst one of the motors is disabled. The favoured type of motor for this type of application (stepper motors) may have insufficient magnetic resistance to apply sufficient drag to the spool support which is not being driven, to maintain adequate tension in the tape during the measurement and calculation process, which leads to inaccurate spool circumference calculations. In turn, this leads to poor tape control during printing operations, because the future control of the spools is based on the assumption that the initial circumference measurements are accurate.

In accordance with a first aspect of the invention, there is provided a method of operation of a tape drive including obtaining the circumferences of a pair of spools of tape, the pair of spools including a supply spool upon which tape is initially wound, and a take-up spool for receiving tape unwound from the supply spool, each spool being mounted upon a respective rotatable spool support which is mounted in a housing, such that tape extends along a tape path between the spools, there being provided a sensor assembly and tension regulation device, the method including

- rotating the take-up spool support and the supply spool support simultaneously, so as to feed tape from the supply spool into the tape path, and to wind tape on to the take-up spool from the tape path,
- determining a length of tape fed into the tape path by the supply spool during a measurement period using the sensor assembly,
- monitoring the angle through which each of the spool supports has rotated during the measurement period,
- regulating the length of tape in the tape path, such that the length of the tape path at the start of the measurement period and the length of the tape in the tape path at the end of the measurement period are substantially the same, and
- using the knowledge of the length of tape fed into the tape path during the measurement period and the angle through which each of the spool supports rotated during the measurement period to obtain the circumferences of the supply spool and the take-up spool.

This method enables the circumferences of both the supply spool and the take-up spool to be calculated, whilst the tension in the tape is maintained without having to carry out separate measurement steps for each of the spools, and without having to drag tape from a spool, thus avoiding the need to use motors which are more highly-powered than is necessary to carry out printing operations. It is not necessary to use slipping clutches to maintain the tension in the tape in the tape path between predetermined limits.

The circumferences of the spools may be determined during a calibration step. It will be understood that one or both of the circumferences may be obtained via a calculation of the diameter of the relevant spool. In other words, the circumferences may be obtained via a determination of the diameters of the spools, or vice versa.

Since the tension of the tape in the tape path is accurately maintained, and during the measurement period, no printing operation is carried out, the tape is unlikely to be distorted during the measurement period. Therefore, the length of the tape path remains substantially constant. The length of the tape in the tape path is regulated, such that there is little or no net change in the tape path during the measurement period. This means that the amount of tape wound on to the take-up spool is the same as the amount of tape which is fed into the tape path by the supply spool, or is similar enough to the amount of tape fed into the tape path for the circumference of the take-up spool to be obtained to within an acceptable tolerance.

The method may include maintaining the tension of the tape in the tape path by adjusting the length of the tape path to accommodate the fluctuations in the length of tape extending between the spools. This adjustment may be made passively, in response to the amount of tape being fed into the tape path being greater than the amount of tape wound on to the take up spool, or vice versa. It is possible to take into account the change in the length of the tape path when obtaining the circumferences of the spools, by providing an indication of the change in the length of the tape path during the measurement period to the controller. Knowledge of the amount of tape fed into the tape path from the supply spool and the change in the length of the tape path during the measurement period enables the amount of tape taken up by the take-up spool to be determined. Thus, any change in the tape length which is necessary to maintain the tension of the tape in the tape path may be taken into account, so as to be able to obtain an accurate circumference of the take-up spool.

The difference in the length of the tape in the tape path at the start of the measurement period and at the end of the measurement period may be less than 1 mm, and is preferably approximately 0 mm.

The difference in the length of the tape in the tape path may fluctuate by less than 0.5% of the length of the tape in the tape path during the measurement period.

The angular velocity of at least one of the spool supports may be adjustable in response to the length of the tape path being adjusted, so as to maintain the length of the tape path between predetermined limits. The adjustment of the angular velocity of at least one of the spool supports acts to return the path length towards a value which is 'neutral' i.e. approximately central between a minimum path length and a maximum path length. Thus, the absolute amount of adjustment in the path length tends towards zero during the measurement period.

The angular velocity of the supply spool may be adjustable.

The method may include providing the tape drive with a tension regulation device and adjusting the length of the tape path by moving at least a part of the tension regulation device relative to the housing and the spool supports.

The method may include providing an indication of the position of the tension regulation device relative to the housing, to the controller and adjusting the angular velocity of at least one of the spools, to move the tension regulation device towards a desired position.

The method may include determining the length of tape fed into the tape path by the supply spool during the measurement period by providing a sensor assembly which includes a roller of known circumference and monitoring the number of revolutions of the roller during the measurement period, so as to determine the length of tape which has passed the roller, and hence has been fed into the tape path. The roller may be associated with the supply spool.

The method may include controlling the duration of the measurement period to ensure that each of the spools rotates through at least one complete revolution during the measurement period. This ensures that the circumferences of the spools obtained are as accurate as possible.

The method may include transferring tape in one direction only between the spools during the measurement period. The circumferences of the spools can be obtained simultaneously, without having to transfer tape in both directions. However, repetition of the measurement operation in either direction may be beneficial to obtain as accurate circumferences as possible.

The method may include determining appropriate relative speeds, i.e. angular velocities, at which to drive the spool supports during transfer of the tape between the spools subsequent to the measurement period, in accordance with the circumferences of the spools. The relative step rates and number of steps per tape movement operation may be controlled during tape transfer by dead reckoning.

In accordance with a second aspect of the invention, there is provided a tape drive including a housing, a first rotatable spool support for supporting a first spool of tape and a second rotatable spool support for supporting a second spool of tape, each rotatable spool support being positioned in the housing and rotatably drivable by a respective motor, the motors being simultaneously energisable, such that when a spool is mounted on each of the spool supports, with tape extending in a tape path between the spools, tape is unwound from a first one of the spools into the tape path and tape is wound on to a second one of the spools from the tape path, so as to transfer tape from one spool to the other, the tape drive further including a sensor assembly which is operable to provide an input relating to the length of tape fed into the tape path during a measurement period to a controller, and a tension regulation device which is moveable relative to the housing and the spool supports to adjust the length of the tape in the tape path, the controller being operable to regulate the length of the tape in the tape path during the measurement period such that the length of the tape in the tape path at the start of the measurement period is substantially the same as the length of the tape in the tape path at the end of the measurement period, and to obtain the circumferences of the first and second spools from the input relating to the length of tape fed into the tape path during the measurement period, and the angle through which each of the spool supports rotated during the measurement period.

The tension regulation device may maintain the tension in the tape in the tape path passively.

The sensor assembly may include a first roller of known circumference, and a rotation sensor for determining the number of revolutions performed by the first roller during the measurement period. This enables the length of tape which has been fed into the tape path to be obtained, and since the angle through which the supply spool has rotated is known, the circumference of the supply spool can be obtained. The length of the tape path may be assumed to be constant, meaning that the length of tape wound on to the take-up spool is the same or substantially the same as the amount of tape fed into the tape path.

Since the angle through which the take-up spool has been rotated is known, the circumference of the take-up spool can also be obtained.

The tension regulation device may include an adjustment roller which is moveable relative to the housing and the spool supports in response to a change in the length of tape between the spools. The adjustment roller may be a guide roller of the tape drive.

The tension regulation device may be operable to adjust the length of the tape path in response to a change in the length of tape between the spools, so as to maintain the tension of the tape in the tape path between predetermined limits during periods other than the measurement period. Thus, in addition to providing a calibration step, before use of the tape drive to transfer the tape from one spool to the other, the tension regulation device may be used to maintain the tension in the tape during use of the tape drive to transfer tape from one spool to the other.

The tape drive may include a position sensor for providing an indication of the position of the adjustment roller to the controller.

The position sensor may include a Hall Effect sensor.

A change in the length of the tape path may be obtainable from an indication relating to a change in position of the adjustment roller during the measurement period.

The tape drive may be reversible such that each rotatable spool support is rotatable in both directions, such that tape is transferable in both directions between the spools.

At least one of the spool support motors, and preferably both, may be a stepper motor.

In accordance with a third aspect of the invention, there is provided a printing apparatus including a tape drive in accordance with the second aspect of the invention, the tape drive being operable to transfer tape being inked ribbon between a pair of spools, the printing apparatus further including a printhead which is positioned adjacent the tape path, and is operable to perform a printing operation to transfer ink from the inked ribbon to a substrate.

The printing apparatus may be a thermal printer.

Figure 2:
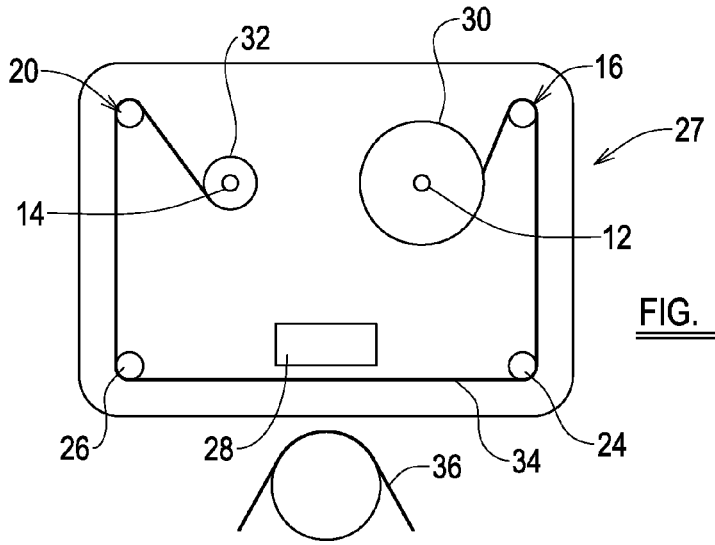
Figure 3:
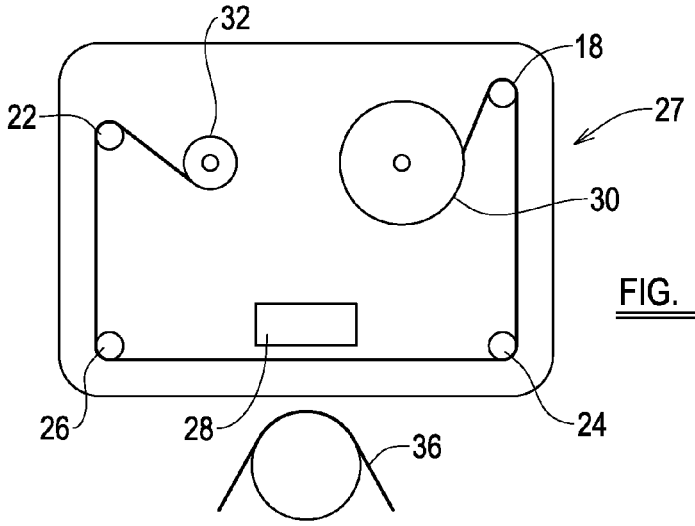
Figure 4:
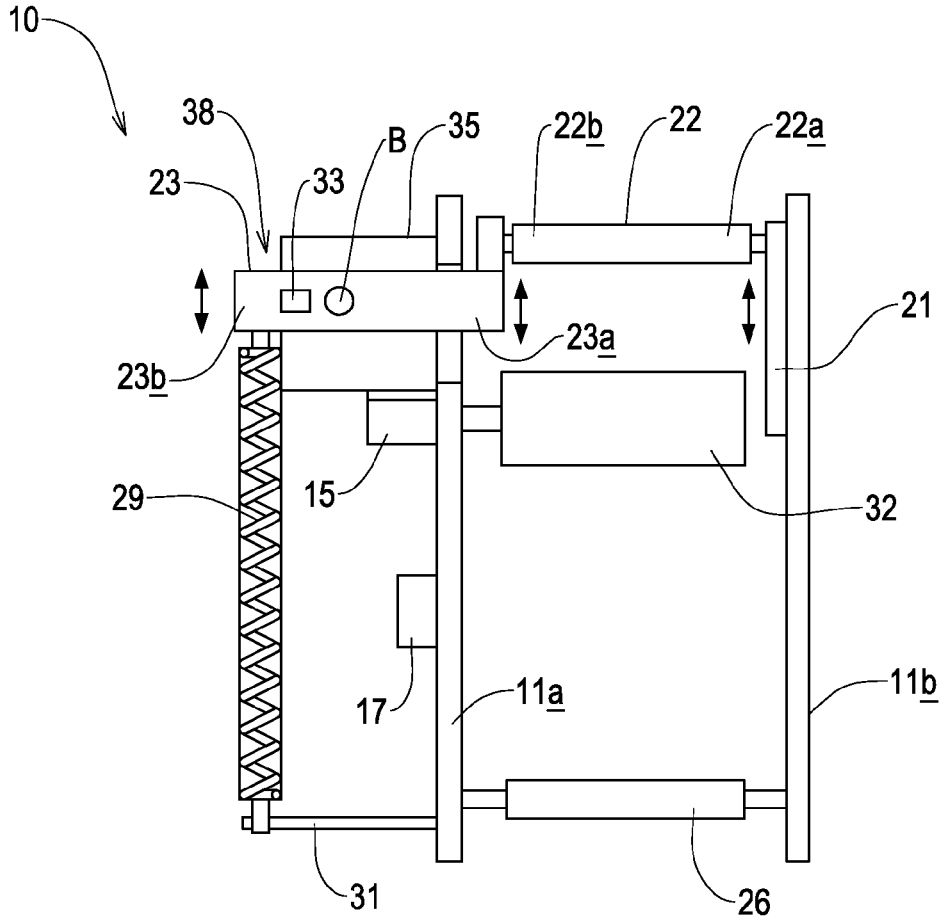

The invention will now be described, by way of example only, with reference to the following drawings, of which:

FIG. 1 shows an illustrative plan view of a tape drive according to the invention, FIG. 2 shows the tape drive in a printing apparatus, in a first configuration, with spools of tape being mounted on spool supports, FIG. 3 shows a similar view to FIG. 2, with the tape drive in a second configuration, and FIG. 4 is a view from line A-A of FIG. 1.

Referring to the figures, there is shown a tape drive 10 which is suitable for use in a printing apparatus, for example a thermal or contact printing apparatus. The tape drive 10 includes a housing 11, in or on which is mounted a first spool support 12 and a second spool support 14. In the present example the housing 11 includes a pair of plates 11*a*, 11*b*, each of which has an in use upper part, and an in use lower part. The two plates 11*a*, 11*b* are releasably connected together. Each of the spool supports 12, 14 is mounted on the first plate 11*a*. A spool of tape, for example inked printer ribbon, is mountable on each of the supports 12, 14. The spool supports 12, 14 are spaced laterally from one another.

Each of the spool supports 12, 14 is independently drivable by a respective motor 15, only one of which is visible in FIG. 4. In the present example, each of the motors 15 is a stepper motor. Each of the spool supports 12, 14 is rotatable clockwise and anti-clockwise. The tape drive 10 includes a controller 17 which is electrically connected to the motors 15 and is operable to control the amount of drive provided by each of the motors, so as to control the angular positions and velocities of the spool supports 12, 14. The position of the controller 17 is unimportant for the purpose of the invention. The controller 17 receives inputs from other components of the tape drive 10, as will be described in more detail below, to determine the desired angular velocities of the spool supports 12, 14, and to provide a corresponding signal to the motors 15.

The tape drive 10 also includes a first sensor assembly 16 which is positioned towards the, in use, upper part of the housing 11, substantially adjacent the first spool support 12. The first sensor assembly 16 is mounted on the first plate 11*a*, but could be mounted on the second plate 11*b*, if desired. The first sensor assembly 16 includes a first rotatable roller 18 of known diameter, and a sensor 19 which is operable to provide an input to the controller 17, to indicate a number of revolutions completed by the roller 18. In the example shown, the sensor assembly 16 is positioned near to the first spool support 12. However, it will be appreciated that the sensor assembly 16 may be positioned elsewhere in the housing 11 relative to the spool supports 12, 14.

The tape drive 10 also includes a tension regulation device 20. The tension regulation device 20 is positioned in the housing 11 substantially adjacent the second spool support 14. The tension regulation device 20 is mounted on the first plate 11*a*, towards the in use upper end thereof. However, it will be appreciated that the tension regulation device 20 may be positioned elsewhere in the housing 11 relative to the spool supports 12, 14.

The tension regulation device 20 includes a tension adjustment roller 22 which is moveable relative to the housing 11 and the spool supports 12, 14. The adjustment roller 22 is able to reciprocate in a generally longitudinal path as indicated by the double headed arrow A, between a first position which is near the, in use, upper end of the plate 11*a*, and a second position which is closer to the in use lower end of the plate 11*a* than the first position. A guide plate 21, which includes a recess in which a first end 22*a* of the adjustment roller 22 is receivable, is carried by the second plate 11*b*. The recess is generally longitudinal, i.e. it extends in the direction of the arrow A, so as to guide the adjustment roller 22 during movement of the adjustment roller relative to the housing 11.

A second end 22*b* of the adjustment roller 22 is attached to a first end 23*a* of a lever 23, which extends through an opening in the plate 11*a*, and is pivotable relative to the plate 11*a*, the adjustment roller 22 and the spool supports 12, 14, about an axis B, which extends in a direction which is transverse to the direction in which each of the spool supports 12, 14 extends.

A second end 23*b* of the lever 23 is connected to a biasing device 29. In the present invention, the biasing device 29 is a tension spring which extends between the lever 23 and a support 31 which is connected to the plate 11*a*, towards the in use lower end thereof. The spring 29 applies a substantially constant force to the adjustment roller 22, via the lever 23, in a generally longitudinal direction, i.e. in the direction indicated by the arrow A.

The tension regulation device 20 also includes a position sensor 38, for obtaining an indication of the position of the adjustment roller 22. The position sensor 38 includes a magnet 33 which is carried by the lever 23, towards the second end 23*b* thereof. The position sensor 38 also includes a Hall Effect sensor 35 which is mounted on the plate 11*a*, such that it is adjacent the magnet 33 carried by the lever 23. The Hall Effect sensor 35 is operable to provide an electrical signal to the controller as a result of movement of the magnet 33 relative to the Hall Effect sensor, the signal being indicative of the position of the lever 23 relative to the plate 11*a*, which in turn is indicative of the position of the adjustment roller 22, as the lever 23 moves relative to the plate 11*a*.

The tape assembly 10 also includes a pair of rotatable guide rollers 24, 26 positioned towards the in use lower end of the plate 11*a*, for guiding a tape extending from the first spool support 12 to the second spool support 14 in a tape path. Additional or fewer guide rollers may be provided, as desired.

In the present example, the tape drive 10 is incorporated in a printing apparatus 27, where its purpose is to advance inked printer ribbon from one spool to another, past a printhead 28, to enable ink to be transferred from the ribbon to a substrate 36, for example paper, labels or product packaging, by the printhead 28. FIGS. 2 and 3 show the position of the printhead 28 relative to the components of the tape drive 10. The printhead 28 is positioned adjacent the tape path, and is movable relative to the housing 11 and the tape path.

In use, a first spool of tape 30 is mounted on the first spool support 12, and a second spool of tape 32 is mounted on the second spool support 14. Tape 34 extends between the first and second spools 30, 32 in a tape path. In the example shown in FIGS. 2 and 3, the spool 30 is a supply spool, on which unused tape is wound, and the spool 32 is a take-up spool onto which used tape is wound.

Tape 34 extends in the tape path from the supply spool 30 around the first roller 18 of the first sensor assembly 16, around the first guide roller 24, adjacent the printhead 28, around the second guide roller 26, around the adjustment roller 22 of the tension regulation device 20, and on to the take-up roller 32.

Tape 34 is generally advanced from the supply spool 30 to the take-up spool 32 by simultaneous energisation of the spool support motors, to unwind tape from the supply spool 30 (driving the first spool support in an anti-clockwise direction as shown in the drawings), and to wind tape on to the take-up spool (driving the second spool support in an anti-clockwise direction). It will be appreciated that the direction of rotation of the spool supports 12, 14 to achieve this simultaneous supply and take-up will depend upon the direction or sense in which the tape is wound on to the spools 30, 32.

As mentioned above, it is desirable to take into account the changing circumferences of the spools 30, 32, in order to rotate the spools 30, 32 at appropriate relative speeds, and/or through appropriate relative angles so as to avoid damaging the tape, and to be able accurately to position a fresh section of tape adjacent the printhead 28.

The tape drive 10 is capable of carrying out a measurement operation to obtain the circumferences of both spools 30, 32 simultaneously. The measurement operation is carried out as a calibration step, for example on start up of the printing apparatus 27. A series of measurement operations may also be carried out during use of the tape drive 10 to transfer tape between the spools 30, 32, so as to monitor the circumferences of the spools 30, 32 over time.

In order to obtain the circumferences of the spools 30, 32, the spool support motors 15 are simultaneously energised, to feed tape 34 from the supply spool 30 into the tape path between the spools 30, 32, and to wind tape 34 on to the take-up spool 32. The second spool support 14 is rotated at a substantially constant angular velocity, i.e. at a substantially constant step rate. However, the angular velocity of the spool support 12 is variable, so as to ensure that the tension in the tape does not exceed a predetermined maximum or minimum.

During a measurement period, the amount of tape being fed into the tape path from the supply spool 30 is measured by the first sensor assembly 16. The movement of the tape 34 fed into the tape path by the supply spool 30 past the roller 18 causes the roller 18 to rotate. The controller 17 receives an indication of the number of revolutions completed by the roller 18 during the measurement period. Since the circumference of the roller 18 is known, the amount of tape 34 which has been fed into the tape path during the measurement period is known. Alternatively, the sensor assembly 16 may calculate the length of tape fed into the tape path and pass an indication of the length of tape fed into the tape path during the measurement period, to the controller 17.

Since the controller 17 controls the energisation of the spool support motors, the controller is able to determine the angle through which each spool support 12, 14 has rotated during the measurement period.

Since the amount of tape fed into the tape path by the supply spool 30 during the measurement period corresponds with a proportion of the circumference of the supply spool 30 (i.e. an arc length), and the angle through which the supply spool 30 has rotated during the measurement period is known, the circumference (and/or diameter) of the supply spool 32 is can be obtained.

The tension regulation device 20 and the controller 17 maintain the tension of the tape 34 between predetermined limits, during the measurement period. In order to maintain the tension of the tape 34 between predetermined minimum and maximum limits during the measurement period, the length of the tape path is adjustable by movement of the adjustment roller 22 relative to the housing 11 and the spool supports 12, 14, between a first position (as shown in FIG. 1) and a second position (as shown in FIG. 2). A neutral position, approximately mid-way between the first and second positions is a desired position of the adjustment roller 22 during use of the tape drive 10. With the sensor assembly 20 in the first position, the length of the tape path is at a maximum, and with the sensor assembly in the second position, the length of the tape path is at a minimum.

The position sensor 38 detects the position of the lever 23, and hence provides an indication of the position of the adjustment roller 22 to the controller 17. In the event that the position sensor 38 provides an indication that the position of the adjustment roller 22 has strayed from its neutral position, and hence that the length of the tape path has changed, the controller 17 carries out a correction, to move the adjustment roller 22 back towards its neutral position. An indication that the adjustment roller has reached or is about to reach the first or the second position, is an indication that the tension in the tape 34 in the tape path is likely to stray beyond one of its predetermined limits, unless a correction is carried out, since the possible change in the length of the tape path is limited by the extent of movement of the adjustment roller 22.

The correction is carried out by increasing or decreasing the angular velocity (i.e. step rate) of the supply spool support 12 relative to the constant angular velocity of the take-up spool support 14. The correction tends to return the adjustment roller 22 towards a central position relative to the housing 11, ensuring that the tension of the tape 34 does not stray beyond the predetermined limits within which the tension regulation device 20 is able to maintain the tension of the tape 34. In the event that the adjustment roller 22 moves beyond its central position in the opposite direction, the position sensor 38 again provides an indication of the position of the adjustment roller 20 to the controller 17, which causes the controller 17 to carry out a correction of the opposite type, i.e. if in the first correction the angular velocity of the supply spool support 12 was increased, the angular velocity of the supply spool support 12 will be decreased in the second correction. Therefore, the adjustment roller 22 may therefore oscillate about its neutral position.

The tension spring 29 ensures that the tension in the tape 34 remains substantially constant, even when the adjustment roller 22 has moved away from its central position.

The tension in the tape 34 is maintained between predetermined limits during the measurement period and the net change in the length of the tape in the tape path during the measurement period is approximately zero. Therefore, since the amount of tape 34 wound on to the take-up spool 32 corresponds with a proportion of the circumference of the take-up spool 32 (i.e. an arc length), and the angle through which the take-up spool 32 has rotated during the measurement period are known, the average circumference (or diameter) of the take-up spool 32 during the measurement period can be obtained. Since the tape 34 is thin, and the measurement period is relatively short, the increase in the circumference of the take-up spool 32 during the measurement period will be small compared with the circumference of the take-up spool 32, and is taken to be negligible. In this example, a single revolution of the largest spool is equivalent to a maximum of approximately 350 mm of tape 34 being fed into the tape path and wound on to the take-up spool 32.

It is possible to determine the change in position of the adjustment roller 22 during the measurement period, by virtue of monitoring the changes in the indications provided to the controller 17 by the position sensor 38. Thus, whilst the net change in the length of the tape path is generally so small as to be assumed to be negligible during the measurement period, as a result of the correction(s) of the angular velocity of the spool support 12 always tending to return the length of the tape path to its "neutral" length, a net change in the path length can be obtained and accounted for when obtaining the diameter of the spools 30, 32. The amount of tape 34 fed into the tape path less the change in the length of the tape path is the amount of tape wound on to the take-up spool 32 during the measurement period.

The duration of the measurement period is controlled so as to ensure that each spool 30, 32 completes at least one full revolution during the measurement period and preferably a plurality of revolutions.

Thus the circumferences of both spools 30, 32 can be obtained in a single step, transferring the tape in single direction during the measurement period. However, in order to improve the accuracy of the circumference obtained during the measurement period, it is advantageous to carry out a further measurement operation. Such a second measurement operation is preferably carried out by reversing the direction of tape transfer, such that tape 34 is fed into the tape path by the take-up spool 32 and is rewound on the supply spool 30. The angular velocity of the supply spool support 12 may differ from the angular velocity of the supply spool support 12 during the first measurement operation to reduce the risk of 'cogging' or jerking movement of the tape 34.

A measurement operation may be carried out in a calibration step prior to operation of the tape drive 10, without the printhead 28 transferring ink from the inked ribbon. Such a calibration step may be carried out on start up of the printing apparatus, and/or when a new tape is mounted on to the spool supports 12, 14. Additionally or alternatively, a series of measurement operations may be carried out continually, to ensure appropriate operation of the tape drive 10 during printing operations.

Once the circumferences of the spools 30, 32 have been obtained, it is possible to determine the appropriate angular velocity of the supply spool relative to the angular velocity of the take-up spool, and/or the number of steps to be carried out by the supply spool 30 relative to the number of steps carried out by the take-up spool, per desired movement of the tape 34, in accordance with the relationship between the circumferences of the spools 30, 32, and the thickness of the tape.

The tape drive 10 is then operable to transfer tape from one spool to the other, generally from the supply spool 30 to the take-up spool 32, although it is also possible to reverse the direction of transfer of the tape, so as to rewind tape on to the supply 30.

The tension in the tape 34 is maintained between predetermined limits during transfer of the tape 34 by "dead reckoning". In the event that the position sensor 38 detects that the adjustment roller 22 has strayed, or is about to stray beyond a predetermined position, the controller 17 is operable to apply a correction to one or both of the spool motors 15, for example by increasing or decreasing the number of steps performed by the motor 15 of the take-up spool support 14 compared with the number of steps carried out by motor 15 of the supply spool support during the same given period. The timing of the correction corresponds to a non-printing operation whilst the next 'fresh' section of inked ribbon (which is preferably positioned directly adjacent a previously used section of inked ribbon), is positioned adjacent the printhead 28 in readiness to perform the next printing operation. The correction is a predetermined number of steps, which corresponds to a predetermined angle. The correction tends to return the adjustment roller 22 towards a central position relative to the housing 11, ensuring that the tension of the tape 34 does not stray beyond the predetermined limits. In the event that the adjustment roller 22 moves beyond its central position in the opposite direction, the position sensor again provides an indication of the position of the adjustment roller 22 to the controller 17, which causes the take-up roller to carry out a correction of the opposite type, i.e. if in the first correction the number of steps carried out by the motor 15 of the tape up spool was increased relative to the number of steps carried out by the supply spool, the number of steps carried out by the take-up spool relative to the supply spool will be decreased in the second correction. The correction may be split between the motors 15, to avoid rewinding or advancing the tape too far.

The spring 29 of the sensor assembly 16 is in this example a long coil tension spring which is capable of much greater elongation than the spring 29 will be subject to in use. Thus the spring 29 applies a substantially constant spring force to maintain the tape tension in the tape path substantially constant.

An alternative device for maintaining the tape tension in the ribbon path could alternatively be provided.

In the event of the tape drive 10 applying a predetermined number of consecutive corrections, i.e. a correction has been applied during a predetermined number of consecutive non-printing operations, in this example four, an adjustment is made to the "dead reckoned" circumference of the take-up spool obtained by calculation by the controller, from the measurements performed during the measurement period and knowledge of subsequent operation of the tape drive.

The printing apparatus 27 into which the tape drive 10 is incorporated may be an intermittent printer, in which in use, a substrate 36 is held stationary, and the printhead 28 is moved relative to the substrate to effect printing, or a continuous printer 28 in which the printhead may be still or moved, while substrate is passed by the printhead 28, or the printing apparatus 27 may be capable of both continuous and intermittent printing.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A method of operation of a tape drive (10), including obtaining the circumferences of a pair of spools (30,32) of tape, the pair of spools (30,32) including a supply spool (30) upon which tape (34) is initially wound, and a take-up spool (32) for receiving tape (34) unwound from the supply spool (30), each spool being mounted upon a respective rotatable spool support (12,14) which is mounted in a housing (11), such that tape (34) extends along a tape path between the spools (30,32), there being provided a sensor assembly (16), the method including rotating the take-up spool support (14) and the supply spool support (12) simultaneously, so as to feed tape (34) from the supply spool (30) into the tape path, and to wind tape (34) on to the take-up spool (32) from the tape path, determining a length of tape (34) fed into the tape path by the supply spool (30) during a measurement period using the sensor assembly (16), monitoring the angle through which each of the spool supports (12,14) has rotated during the measurement period, regulating the length of the tape (34) in the tape path, such that the length of the tape (34) in the tape path at the start of the measurement period and the length of the tape (34) in the tape path at the end of the measurement period are substantially the same, and using knowledge of the length of tape (34) fed into the tape path during the measurement period and the angle through which each of the spool supports (12,14) rotated during the measurement period to obtain the circumferences of the supply spool (30) and the take-up spool (32).

2. A method according to claim 1 wherein the tension of the tape (34) in the tape path is maintained between predetermined limits by adjusting the length of the tape path during the measurement period to accommodate fluctuations in the length of tape (34) extending between the spool supports (12,14).

3. A method according to claim 1 wherein the difference in the length of the tape (34) in the tape path between the start and the end of the measurement period is less than 1 mm.

4. A method according to claim 1 wherein the difference in the length of the tape (34) in the tape path at the start and the end of the measurement period is approximately 0 mm.

5. A method according to claim 1 wherein the length of the tape (34) in the tape path fluctuates by less than 0.5% of the length of the tape (34) in the tape path during the measurement period.

6. A method according to claim 2 wherein the angular velocity of at least one of the spool supports (12,14) is adjustable in response to the length of the tape path being adjusted, so as to maintain the length of the tape path between predetermined limits.

7. A method according to claim 6 wherein the angular velocity of the supply spool support (12) is adjustable.

8. A method according to claim 6 wherein the tension of the tape (34) in the tape path is maintained substantially constant.

9. A method according to claim 2 including providing the tape drive (10) with a tension regulation device (20) and adjusting the tape path length by moving at least a part of the tension regulation device (20) relative to the housing (11) and the spool supports (12,14).

10. A method according to claim 9 including providing an indication of the position of the tension regulation device (20) relative to the housing (11), to a controller (17) and adjusting the angular velocity of at least one of the spool supports (12,14), to move the tension regulation device (20) towards a desired position.

11. A method according to claim 1 including determining the length of tape (34) fed into the tape path from the supply spool (30) by providing a sensor assembly (16) which includes a roller (18) of known circumference and monitoring the number of revolutions of the roller (18), so as to determine the length of tape (34) which has passed the roller (18).

12. A method according to claim 1 including controlling the duration of the measurement period to ensure that each of the spools (30,32) rotates through at least one complete revolution during the measurement period.

13. A method according to claim 1 wherein tape (34) is transferred in one direction only between the spools (30,32) during the measurement period.

14. A method according to claim 1 including determining appropriate relative speeds at which to drive the spool supports (12,14) during transfer of the tape (34) between the spools (30,32), subsequent to the measurement period in accordance with the circumferences of the spools (30,32).

15. A tape drive (10) including a housing (11), a first rotatable spool support (12) for supporting a first spool (30) of tape (34) and a second rotatable spool (14) support for supporting a second spool (32) of tape (34), each rotatable spool support (12,14) being positioned in the housing (11) and rotatably drivable by a respective motor (15), the motors (15) being simultaneously energisable, such that when a spool (30,32) is mounted on each of the spool supports (12,14), with tape (34) extending in a tape path between the spools (30,32), tape is unwound from a first one of the spools (30,32) into the tape path and tape (34) is wound on to a second one of the spools (30,32) from the tape path, so as to transfer tape (34) from one spool (30,32) to the other, the tape drive (10) further including a sensor assembly (16) which is operable to provide an input relating to the length of tape (34) fed into the tape path during a measurement period to a controller (17), and a tension regulation device (20) which is moveable relative to the housing (11) and the spool supports (12,14) to adjust the length of the tape (34) in the tape path, the controller (17) being operable to regulate the length of the tape (34) in the tape path during the measurement period, such that the length of the tape (34) in the tape path at the start of the measurement period is substantially the same as the length of tape (34) in the tape path at the end of the measurement period, and to obtain the circumferences of the first and second spools (30, 32) from the input relating to the length of tape (34) fed into the tape path during the measurement period, and the angle through which each of the spool supports (12,14) rotated during the measurement period.

16. A tape drive (10) according to claim 15 wherein the sensor assembly (16) includes a first roller (18) of known circumference, and a sensor (19) for determining the number of revolutions performed by the first roller (18) during the measurement period.

17. A tape drive (10) according to claim 15 wherein the tension regulation device (20) includes an adjustment roller (22) which is moveable relative to the housing (11) and the spool supports (12,14) in response to a change in the length of the tape (34) between the spools (30,32).

18. A tape drive (10) according to claim 17 including a position sensor (38) for providing an indication of the position of the adjustment roller (22) to the controller (17).

19. A tape drive (10) according to claim 18 wherein the position sensor (38) includes a Hall Effect sensor (35).

20. A tape drive (10) according to claim 15 wherein the tension regulation device (20) is operable to adjust the length of the tape path in response to a change in the length of the tape (34) between the spools (30,32), so as to maintain the tension of the tape (34) in the tape path between predetermined limits during periods other than the measurement period.

21. A tape drive (10) according to claim 15 wherein a change in the length of the tape path is obtainable from an indication relating to a change in position of the adjustment roller (22) during the measurement period.

22. A tape drive (10) according to claim 15 which is reversible such that each rotatable spool support (12,14) is rotatable in both directions, such that tape (34) is transferable in both directions between the spools (30,32).

23. A tape drive (10) in accordance with claim 15 wherein at least one of the spool support motors (15) is a stepper motor.

24. A tape drive (10) in accordance with claim 23 wherein both spool support motors (15) are stepper motors.

25. A printing apparatus (27) including a tape drive (10) according to claim 15, the tape drive (10) being operable to transfer tape (34) being inked ribbon between a pair of spools (30,32), the printing apparatus (27) further including a printhead (28) which is positioned adjacent the tape path, and is operable to perform a printing operation to transfer ink from the inked ribbon to a substrate (36).

26. A printing apparatus (27) according to claim 25 which is a thermal printer.

* * * * *